United States Patent [19]

Appleman et al.

[11] Patent Number: 4,632,068

[45] Date of Patent: Dec. 30, 1986

[54] MODULAR SLUDGE COLLECTION SYSTEM FOR A NUCLEAR STEAM GENERATOR

[75] Inventors: Robert H. Appleman; Jeffrey D. Bein, both of Pleasant Hills; Frank S. Powaski, Irwin, all of Pa.

[73] Assignee: Westinghouse Electric Corp., Pittsburgh, Pa.

[21] Appl. No.: 613,673

[22] Filed: May 24, 1984

[51] Int. Cl.[4] ..... F22B 1/02

[52] U.S. Cl. ..... 122/34; 122/386; 122/405

[58] Field of Search ..... 122/32, 33, 34, 379, 122/380, 381, 382, 383, 384, 390, 392, 399, 405

[56] References Cited

U.S. PATENT DOCUMENTS

| | | | |
|---|---|---|---|
| 1,582,148 | 4/1926 | Stockholder | 122/381 |
| 1,616,372 | 2/1927 | Janson | 122/383 |
| 2,024,564 | 12/1935 | Brand | 122/405 |
| 3,916,844 | 11/1975 | Cassell | 122/381 |
| 4,079,701 | 3/1978 | Hickman et al. | 122/382 |
| 4,303,403 | 12/1981 | Redding | 122/382 |
| 4,407,236 | 10/1983 | Schukei et al. | 122/390 |
| 4,452,183 | 6/1984 | Yazidjian | 122/390 |

*Primary Examiner*—Albert J. Markay
*Assistant Examiner*—Steven E. Warner
*Attorney, Agent, or Firm*—R. P. Lenart

[57] ABSTRACT

A sludge collection system for a vertically oriented nuclear steam generator is provided with an upwardly open chamber for receiving separated liquid and incoming feedwater that contain sludge particulates. A plurality of sludge collecting containers are positioned within the chamber and include a top rim encompassing an opening leading into the interior of each container. Generally flat perforated covers are positioned over each container such that a gap is formed between the cover and the adjacent top rim. Particulate material in the water entering the container can settle within the container because of relatively stagnant conditions. Sludge agitation and removal means are provided for remotely cleaning the containers. The sludge collection system components are sized to permit retrofitting this system into existing steam generators.

15 Claims, 15 Drawing Figures

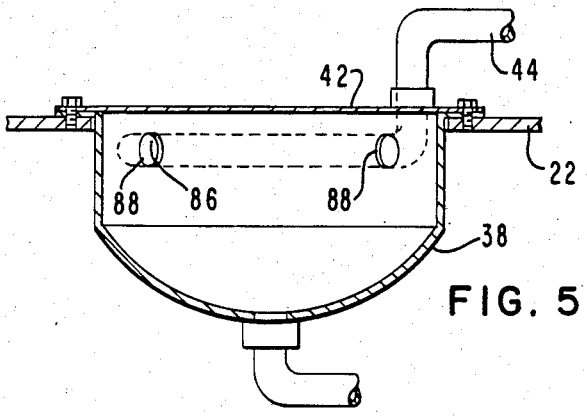
FIG. 5
FIG. 6
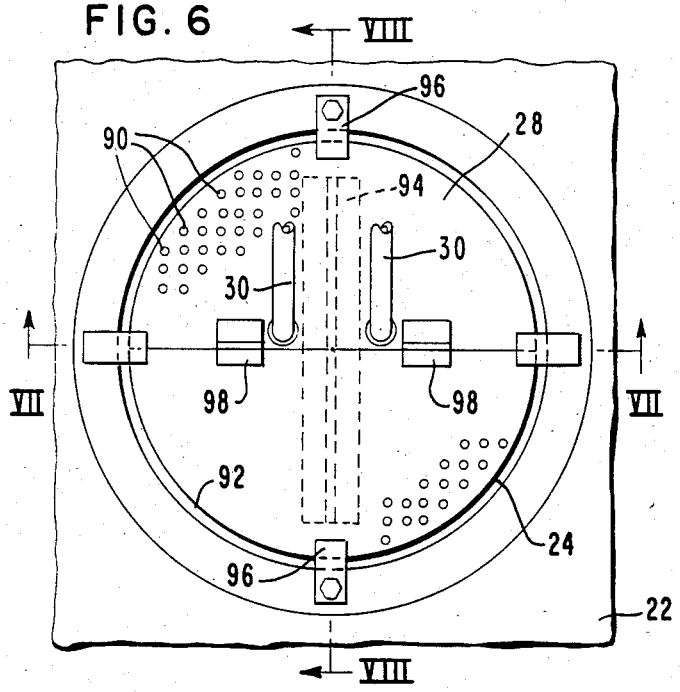
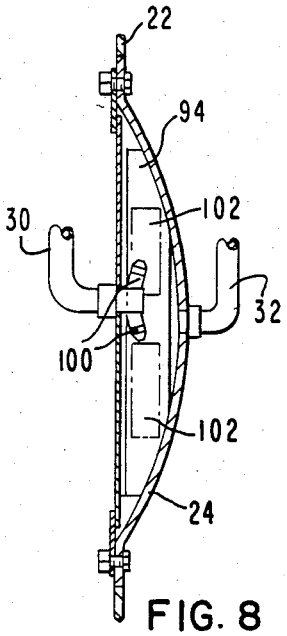
FIG. 8
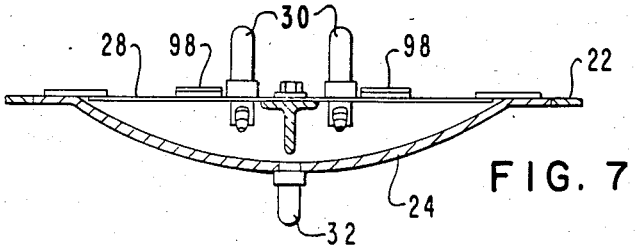
FIG. 7

MODULAR SLUDGE COLLECTION SYSTEM FOR A NUCLEAR STEAM GENERATOR

BACKGROUND OF THE INVENTION

This invention relates generally to nuclear steam generators and more particularly to a modular sludge collecting system for collecting concentrated solids from recirculating water and feedwater within the generator.

It is well known in the art of nuclear steam generators to have certain spaces or volumes therein of relatively low velocity fluid flow to give the solids suspended in the fluid an opportunity to settle out in an area where they can be relatively easily collected and eliminated from the generator.

One example of such structure in a shell and tube type vapor or steam generator is shown in U.S. Pat. No. 3,916,844, wherein the feedwater, upon entering the shell, is received in a large annular settling chamber of low liquid velocity which extends adjacent to the generator shell. This settling chamber intercepts the incoming feedwater, which does not have a very high concentration of suspended solids per unit volume, and also receives returning carry-over water which has a much higher concentration of suspended particles, but which becomes considerably diluted upon mixing with the incoming feedwater within the chamber. Consequently, to be effective, a very large volume of low velocity feedwater is necessary for effective removal of suspended solids.

U.S. Pat. No. 4,303,043 discloses a nuclear steam generator having a settling chamber or sludge collection chamber which is interposed between the recirculating carry-over water and the incoming feedwater, to intercept the recirculating water and retain at least a portion thereof in a sustantially stagnant condition to permit the entrained solids to be deposited within the chamber. Baffle means are provided to limit the exchange of the continuously incoming carry-over water with the water already retained in the chamber to minimize turbulence, yet permit some rate of exchange between the incoming recirculating water and the water in the chamber from which the sediments have already been removed. Although the large settling chamber disclosed in that patent is suitable for original equipment fabrication, that system cannot be feasibly applied on a retrofit basis because of internal component obstructions and because of limited access to the upper regions of the steam generator. In both of the above patents, sludge removal is effected through a single blowdown pipe, which if clogged, would disable the entire sludge collecting system.

SUMMARY OF THE INVENTION

The present invention provides a modular sludge collection system which can be retrofitted into existing steam generators for the collection and removal of sludge at locations away from the tubesheet. This modular design can provide a significant reduction in the quantity of particulate matter in a presently operating steam generator, thereby minimizing the potential for corrosion accelerating deposits in the vicinity of the tube-to-tubesheet interface. It includes a plurality of small collectors which are strategically placed within the upper regions of a steam generator and may include piping for remote cleaning of the collectors. All components are of a size, or can be broken down to a size, which fits through existing secondary manways and other passageways to the points of attachment.

A sludge collection system for vertically oriented nuclear steam generators constructed in accordance with the present invention comprises: an upwardly open chamber for receiving a mixture of feedwater and liquid which has been separated from the vapors produced within the steam generator prior to the mixture entering the steam producing region of the generator; a plurality of sludge collecting containers positioned within the chamber, wherein each of the containers includes an upwardly facing dished portion and a top rim encompassing an opening leading to the interior of each container; and a plurality of generally flat perforated covers, each being positioned over one of the openings such that a gap is formed between each of the covers and the top of an adjacent container. In one embodiment, this gap may be formed by utilizing covers that have a shape which is similar to the shape of the top rim of the corresponding container while being smaller than the corresponding opening. Alternatively, the covers may be mounted such that they are spaced above the adjacent containers. The sludge collecting containers may be equipped for remote cleaning by providing means for agitating the collected sludge and means for removing the agitated sludge. Alternatively, the collectors can be removed for cleaning or cleaned in place within the steam generator, for example, by hydro-mechanical vacuuming.

BRIEF DESCRIPTION OF THE DRAWINGS

FIG. 5 is a cross-sectional view of the sludge collecting container of FIG. 4 having an alternative sludge agitation system;

FIG. 6 is a plan view of the top of the central sludge collecting container in the steam generator of FIG. 1;

FIG. 7 is a cross-sectional view of the sludge collecting container of FIG. 6 taken along line VII—VII;

FIG. 8 is a cross-sectional view of the sludge collecting container of FIG. 6 taken along line VIII—VIII;

DESCRIPTION OF THE PREFERRED EMBODIMENTS

Figure 1:
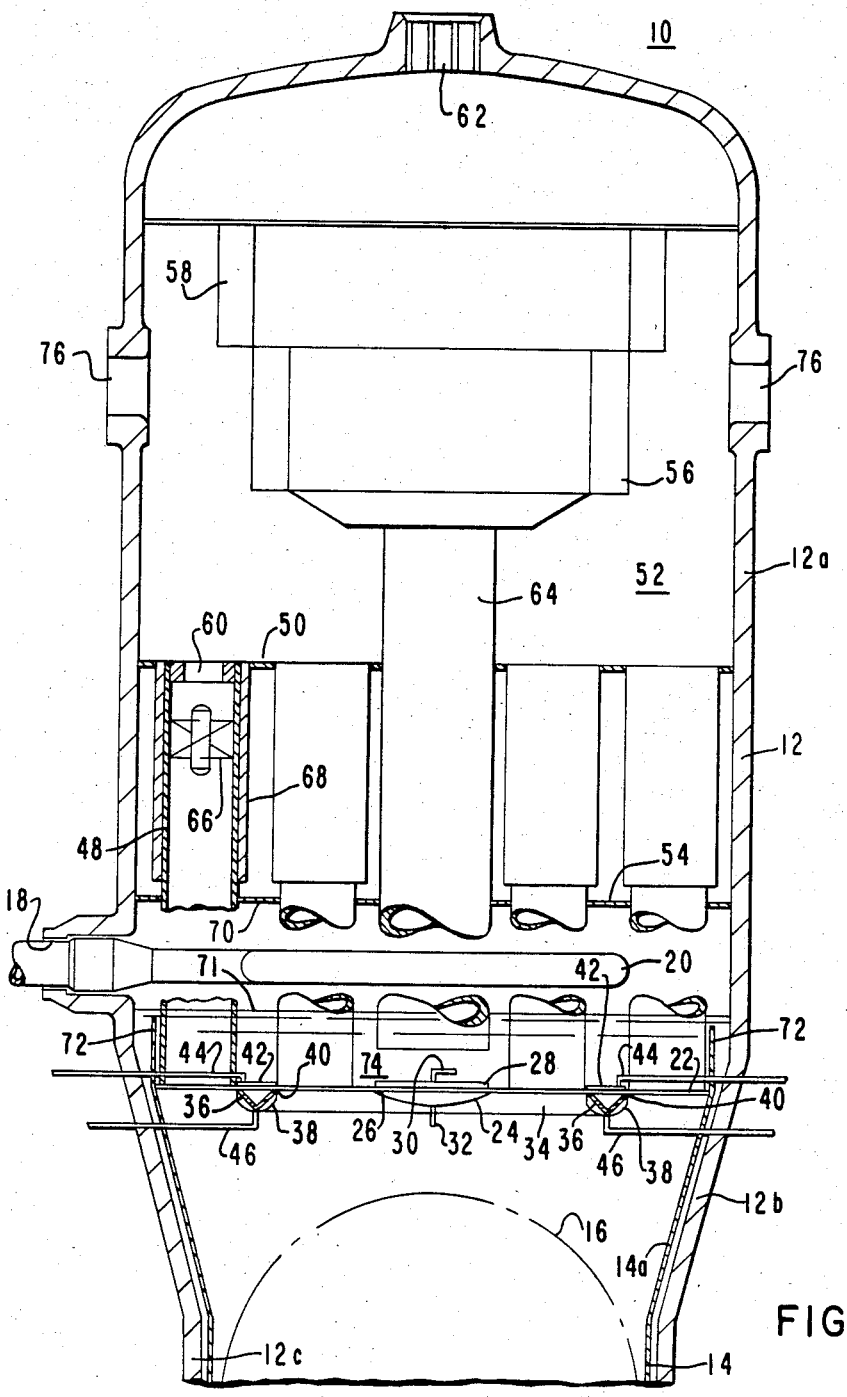
FIG. 1 is a partial cross-sectional view, in elevation, of the upper portion of a steam generator, having a sludge collection system in accordance with one embodiment of the present invention.

Referring to the drawings, FIG. 1 is partial cross-sectional view, in elevation, of the upper portion of a vertical nuclear steam generator which includes one embodiment of the present invention sludge collection system. A vertical U-tube steam generator of the type generally referred to herein is more fully described in commonly owned U.S. Pat. No. 4,079,701, which is herein incorporated by reference for the general description of a nuclear steam generator. FIG. 1 shows the upper portion of a vertically oriented nuclear steam generator 10 which includes an outer generally cylindrical shell 12, with the upper portion 12*a*, and a transition portion 12*b* being shown to enclose, in an annular spaced relationship, a cylindrical wrapper 14, with transition portion 14*a*, and an enclosed U-tube bundle 16. A feedwater inlet 18 to an annular feedwater discharge ring 20 is shown to be positioned above a generally horizontal lower deck plate 22, and is located between an inner and an outer circle of primary separation equipment cylinders. In alternative embodiments, the feedwater inlet 18 and annular feedwater discharge tube 20 may be positioned in the annular space between the shell 12 and wrapper 14 as shown in U.S. Pat. No. 4,303,043, or feedwater may be introduced near the bottom of the tube bundle as in steam generators which include a preheater.

The feedwater discharge ring 20 provides feedwater which mixes with recirculating water and flows into the heat exchanger section comprising the tube bundle 16 and its accompanying support system, whereupon the recirculating water mixture is partially changed to steam. The steam then rises due to density differences between the steam and the water. The rising steam passes through two stages of separation equipment, 48, 66, 56 and 58, which remove entrained water to leave essentially dry steam. This steam then leaves the steam generator and circulates through electrical generating equipment in a manner well known in the art.

During the water separation process, particulate matter is extracted from the steam/water mixture and concentrated within the recirculating water. Additional particulate matter enters the steam generator through the feedwater distribution system. Thus, the recirculating water/feedwater mixture contains heavy solid particulate contaminants which can produce an undesirable sludge if allowed to enter the tube bundle with the normal flow of recirculating water. By natural settling processes (gravity, density differences, etc.) the heavy particulates will tend to move downward toward the lower deck plate 22 unless intercepted by some obstruction or unless the natural turbulent mixing of the recirculating water forces the particulates to remix and spill into the annulus between the shell and the tube bundle enclosing wrapper. If this occurs, the particulates will reenter the heat exchange section which includes the tube bundle and could then collect at the numerous intersections within the tube bundle or on the tube sheet where the resulting sludge can lead to damaging corrosion of the tube bundle and supporting structures.

Lower deck plate 22 includes a centrally dished configuration 24 which is used as one of the sludge collecting containers of the present invention in this embodiment. The dished configuration 24 has an upper rim 26 and is fitted with a perforated hinged cover 28 having the same general shape as rim 26 but being smaller in size such that a gap is formed between the perimeter of cover 28 and rim 26. Blowdown feedwater pipe 30 is connected to a nozzle or blowdown feedwater ring structure, not shown, which serves as means for agitating sludge collected within the container formed by dished portion 24. The agitated sludge can be removed by suction through pipe 32. By using a plurality of sludge collecting containers, each having its own remote cleaning piping, relatively small diameter pipes can be used so that large openings through the pressure boundary are avoided.

Lower deck plate 22 is supported by a gusset 34 having a circular stiffening V-ring 36. In this embodiment, holes have been cut within lower deck plate 22 and a portion of the V-ring has been removed to accommodate the placement of additional sludge collecting containers 38. Each of these containers is provided with a perforated cover 42 having a shape which is similar to, but smaller than, the rim 40 of the containers. Independent and distinct blowdown feedwater pipes 44 and sludge removal pipes 46 are included to agitate and remove collected sludge in the same manner as discussed above with respect to dished portion container 24.

Steam generated within the wrapper or tube bundle enclosure 14, along with entrained water, flows upwardly through a plurality of primary vapor separators 48 extending vertically from lower deck plate 22 and in vapor flow communication with the wrapper interior. The upper ends of separators 48 pass through and are supported by an upper plate member, or mid-deck plate, 50 and discharge the steam into an upper chamber 52 in the shell 12. The separators 48 are further supported by an intermediate horizontal plate, or intermediate deck plate, 54.

A pair of vertically stacked chevron moisture separators 56 and 58 are supported within chamber 52 in a series flow relationship with the primary vapor separator outlet nozzles 60, such that steam within chamber 52 must pass through the separators prior to being discharged from the generator through outlet port 62. The entrained water which is separated from the vapor by the chevron separators 56 and 58 is collected and drains through a central vertical drain pipe 64 which extends to a point near lower deck plate 22.

Vapor separating swirl vanes 66 are disposed within each primary vapor separator 48 adjacent to the discharge nozzle and orifice 60 to initially separate the entrained water from the vapor passing therethrough. Due to the contour of the swirl vanes, the mixture velocity and mixture density differences the separated water is centrifuged in an outward fashion toward the primary separator enclosures where it flows through annular water downcomers 68 which discharge the water onto the upper surface of the intermediate support or deck plate 54. This intermediate support plate has a plurality of openings 70 for gravity draining of the separated water.

Thus, it can be seen that all water condensed or separated from the vapor discharged from the wrapper 14 is eventually collected and directed back to the lower deck plate 22. The transition portion 12b and lower portion 12c of shell 12 form an upwardly open chamber which receives the recirculating water and feedwater mixture which forms a pool having a top level 71 as shown in FIG. 1. In an alternative embodiment, a vertical cylindrical wall 72 may extend upwardly from the peripheral edge of the lower deck plate 22 to form an upwardly facing chamber 74 into which all such water separated from the steam flow is eventually drained. If used, this upwardly open chamber 74 would be fitted with separated water having a relatively low velocity fluid flow to give the solids suspended in the fluid an opportunity to settle into collection containers 24 and 38. It should be understood that vertical wall 72 is not essential to the present invention since the level of the feedwater/recirculating water mixture is normally maintained above the lower deck plate without the use of this vertical wall.

Figure 2:
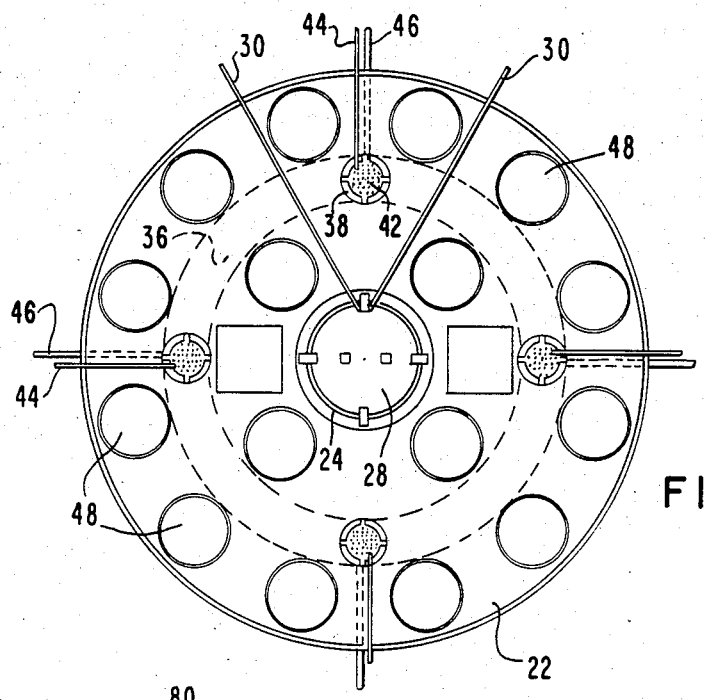
FIG. 2 is a plan view of the lower deck plate of the steam generator of FIG. 1.

FIG. 2 is a plan view of the lower deck plate 22. Sludge collecting containers 38 and their associated covers 42 are seen to be strategically placed between the riser pipes of the primary separators 48. It should be noted that the sludge collecting containers 38 and covers 42 are sized such that they may be inserted through manways 76 in FIG. 1 and then pass through spaces between the riser pipes of primary separators 48 to reach the lower deck plate 22. Cover 28 on central dished portion 24 of lower deck plate 22 is seen to be hinged so that it can also be inserted through manways 76 in FIG. 1.

Figure 3:
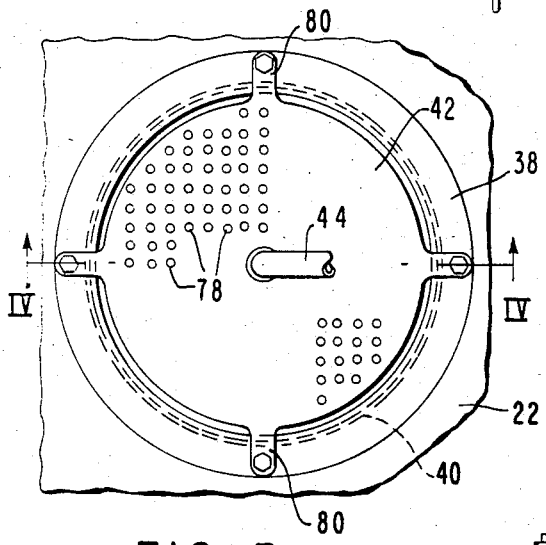
FIG. 3 is a plan view of the top of one of the sludge collecting containers in the steam generator of FIG. 1.

FIG. 3 is a plan view of the top of a sludge collecting container 38. In this view, it can be seen that cover 42 is provided with a plurality of holes 78 arranged in a defined square penetration pattern. Although only a portion of cover 42 is shown to be perforated, it should be understood that the pattern of holes 78 is repeated over the entire surface of cover 42. In addition, the cover holes need not be arranged in a square pattern. For example, 5/16 inch diameter holes in a triangular pattern have been successfully tested. Mounting lugs 80 are used to secure cover 42 above sludge collecting container 38. In this embodiment, rim 40 of container 38 is shown to be circular. Cover 42 has a circular perimeter but is slightly smaller than the circle formed by rim 40 such that an annular gap 82 is formed between the perimeter of the cover and the adjacent rim. Recirculating water and sludge producing contaminants are admitted to the sludge collecting container through the cover holes and the annular gap. The cover plate creates a low velocity zone within the container which assists in retaining collected sludge in individual modules and aids in the prevention of the reentrainment of sludge into the recirculating steam/water mixture.

Figure 4:
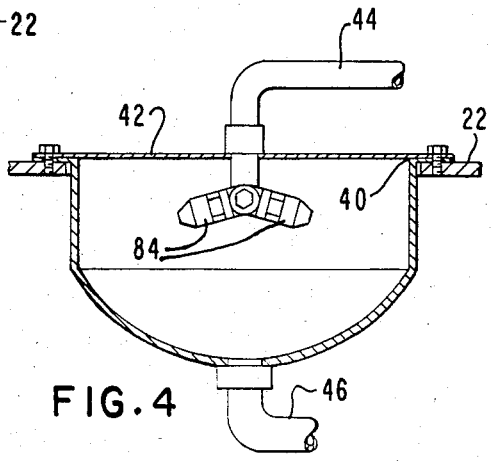
FIG. 4 is a cross-sectional view of the sludge collecting container of FIG. 3 taken along line IV—IV.

FIG. 4 is a cross-section of the sludge collecting container of FIG. 3 taken along line IV—IV. In this view, a pair of manually adjustable and secured nozzles 84 are shown to be connected to blowdown feedwater inlet pipe 44, and serve as means for agitating sludge which is collected within container 38. The agitated sludge can then be removed through sludge removal pipe 46. Separate sludge removal structures can be fitted to each module, thereby providing redundancy such that the failure of any individual module will not disable the entire cleaning system.

FIG. 5 shows an alternative sludge agitating means which includes an annular blowdown pipe 86 which is connected to blowdown feedwater inlet pipe 44 and includes a plurality of holes 88 that serve to disperse the blowdown feedwater in a shower type of distribution system, thereby agitating collected sludge.

FIG. 6 is a plan view of the sludge collecting container formed by dished portion 24 in FIG. 1. A circular hinged cover 28 is provided with a plurality of holes 90 which are arranged in a tightly packed and defined triangular pattern. The cover 28 has a diameter which is slightly smaller than the diameter of the rim of the dished portion 24, thereby providing an annular gap 92 between the perimeter of cover 28 and dished portion 24. Cover 28 rests on a T-shaped support member 94 and is secured to the lower deck plate 22 by mounting lugs 96. Support member 94 is shown in the form of a T-shaped structural member with mixing slots as shown in FIG. 8. A pair of hinges 98 are provided so that one-half of cover 28 can be folded for service, removal and insertion through the manway 76 in FIG. 1.

FIG. 7 is a cross-sectional view of the sludge collecting container of FIG. 6 taken along line VII—VII. This view more clearly illustrates the T-shaped structural support member 94.

FIG. 8 is a cross-sectional view of the sludge collecting container of FIG. 6 taken along line VIII—VIII. In this view, sludge agitating nozzles 100 are shown to be connected to blowdown feedwater inlet pipe 30. T-shaped member 94 is seen to include apertures or flow slots 102 which provide fluid communication between the interior sides of the dished portion 24 which are separated by member 94.

Figure 9:
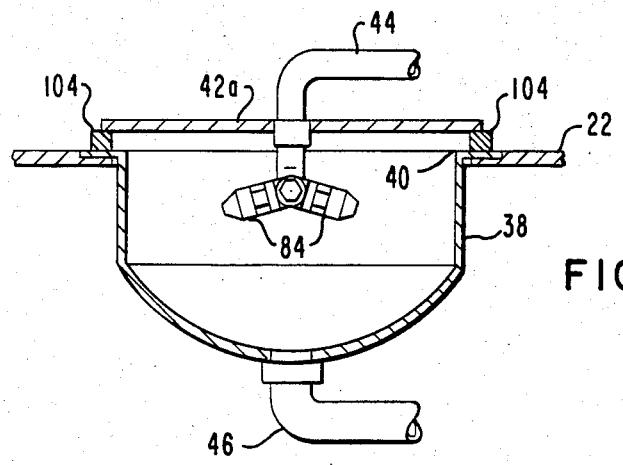
FIG. 9 is a cross-sectional view of an alternative embodiment of a sludge collecting container in accordance with this invention.

FIG. 9 is a cross-sectional view of an alternative embodiment of a sludge collecting container constructed in accordance with this invention. In this embodiment, perforated cover **42*a* has a diameter which is greater than that of the container rim 40. Spacers 104 are placed at selected locations such that the cover is held a fixed distance from the container rim, thereby forming an annular gap between the cover and the rim. It should be apparent that the spacers 104 may be positioned at locations corresponding to the lugs 80 of FIG. 3** and that the diameter of the cover may be less than, equal to, or greater than that of the container rim.

Figure 10:
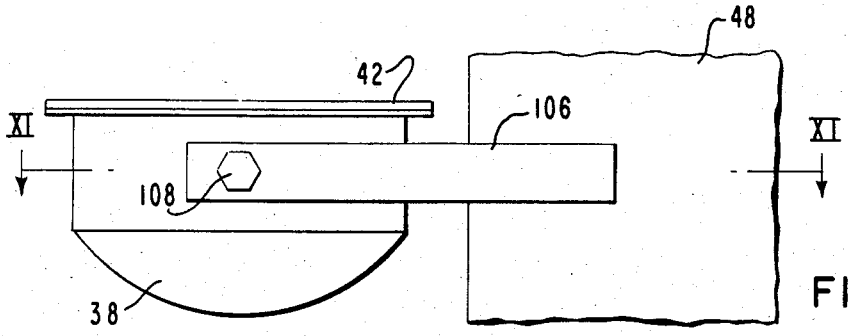
FIG. 10 is an elevational view of another alternative embodiment of a sludge collecting container in accordance with this invention.
Figure 11:
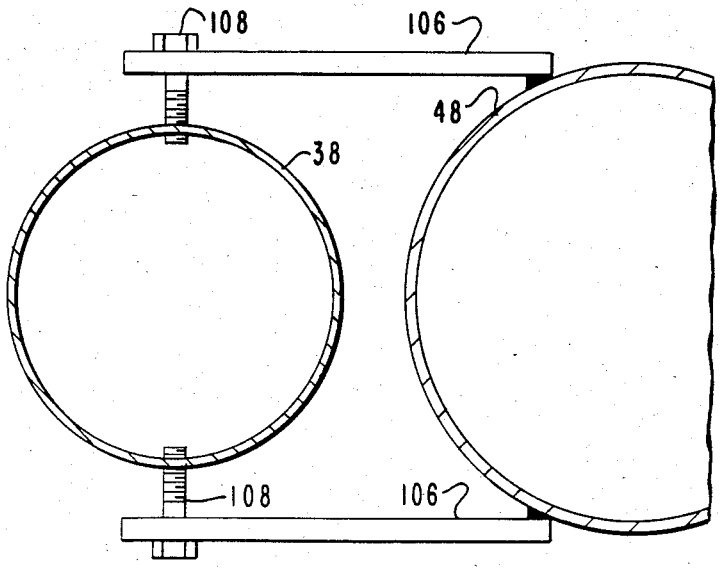
FIG. 11 is a cross-sectional view of the sludge collecting container of FIG. 10 taken along line XI—XI.

FIGS. 10 and 11 show another alternative sludge collecting container which is mounted on a primary separator riser tube 48. The container 38 is detachably connected to a pair of supports 106 by means of bolts 108. Supports 106 are attached, for example by welding, to riser tubes 48 at a lever such that the tops of the sludge collecting containers are below the water level of the steam generator.

Figure 12:
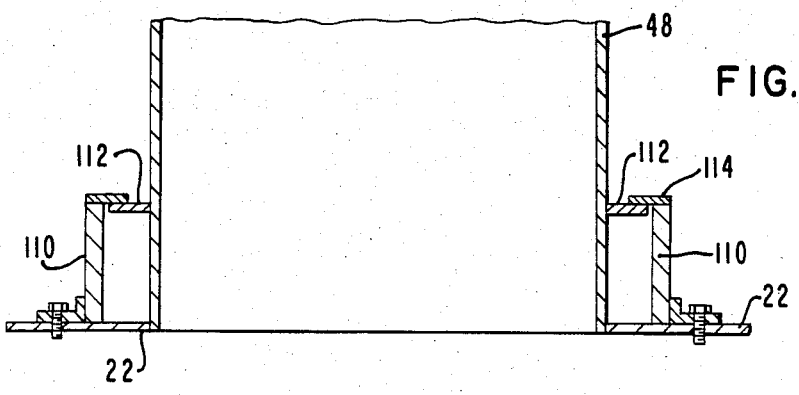
FIG. 12 is a cross-sectional view of yet another embodiment of a sludge collecting container in accordance with this invention.
Figure 13:
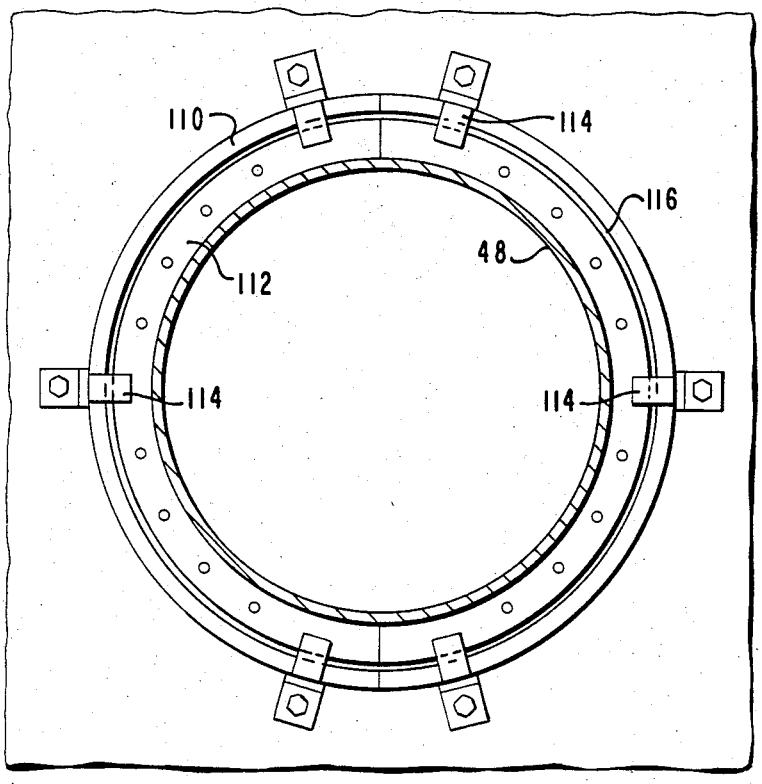
FIG. 13 is a plan view of the sludge collecting container of FIG. 12.

FIGS. 12 and 13 show yet another sludge collecting container which is positioned around a primary separator riser tube 48. In this embodiment, the container comprises two semicylindrical sections 110 which are placed around a riser tube 48 and bolted to the lower deck plate 22. Similarly, the cover includes two semicircular perforated sections 112 which are positioned by way of mounting lugs 114 to form an annular gap 116 between the cover sections 112 and the container sections 110. It should be apparent that the cover sections can be sized to overlap the rim of the container sections, in which case spacers can be used to maintain the annular gap.

Figure 14:
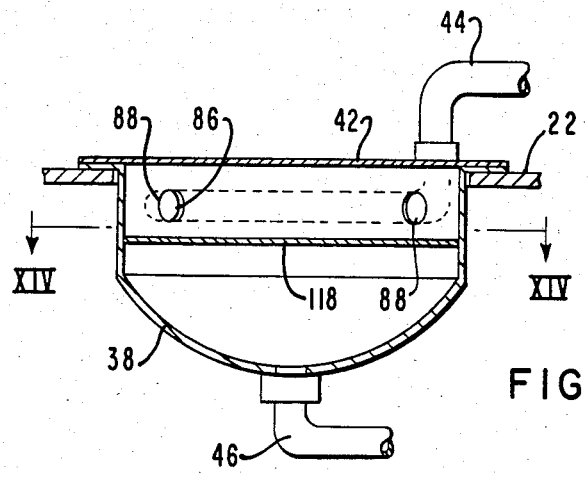
FIG. 14 is a cross-sectional view of an additional embodiment of a sludge collecting container in accordance with this invention.
Figure 15:
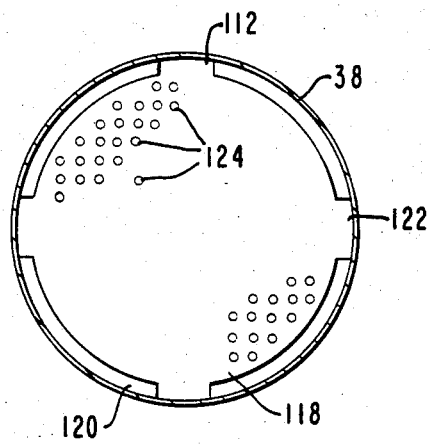
FIG. 15 is a cross-sectional view of the sludge collecting container of FIG. 14 taken along line XV—XV.

FIGS. 14 and 15 show an additional embodiment of a sludge collecting container which includes a baffle plate 118 positioned below the cover plate 42. As shown in FIG. 15, baffle plate 118 has a diameter which is smaller than the internal diameter of container 38, thereby forming an annular gap 120 between the baffle and the container. A plurality of mounting tabs 122 are provided which may be welded to the container 38 to position the baffle. A plurality of holes 124 is provided in the baffle in a pattern which may be similar to that of the cover plate. These holes may be offset from those of the cover plate to prevent direct vertical flow between the cover plate and the baffle. It should be understood that other baffle designs which tend to improve stagnant conditions in the container are also within the scope of this invention.

Although the present invention has been described in terms of what at present are believed to be the preferred embodiments, it will be apparent to those skilled in the art that various changes may be made to these embodiments without departing from the scope of the invention. The appended claims are intended to encompass all such changes.

What is claimed is:

1. A sludge collection system for a vertically oriented nuclear steam generator wherein vapors produced in the steam generator pass through means for separating entrained liquid from the vapor prior to the vapor being discharged from the steam generator, said sludge collection system comprising;

an upwardly open chamber for collecting the separated liquid and feedwater entering the steam generator;

a plurality of upwardly open sludge collecting containers positioned within said chamber, wherein each of said containers includes a top rim encompassing an opening leading to the interior of each container;

a plurality of generally flat, perforated covers, each of said covers being positioned over one of said openings such that a gap is formed between the cover and the adjacent top rim;

sludge agitating means on at least one of said containers; and sludge removal means on at least one of said containers.

2. A sludge collection system as recited in claim 1, wherein at least one of said rims is circular and the gap adjacent to that rim is annular.

3. A sludge collection system as recited in claim 1, wherein said covers are perforated by a plurality of holes arranged in a square pattern.

4. A sludge collection system as recited in claim 1, wherein said covers are perforated by a plurality of holes arranged in a triangular pattern.

5. A sludge collection system as recited in claim 1, further comprising:

a plurality of mounting lugs located adjacent to the perimeter of each of said covers.

6. A sludge collection system as recited in claim 1, wherein said sludge agitating means comprises:

an agitator feedwater ring attached to the container side of at least one of said covers; and means for delivering agitation feedwater to said ring.

7. A sludge collection system as recited in claim 1, wherein said sludge agitating means comprises:

a spray nozzle within at least one of said containers; and means for delivering agitator feedwater to said spray nozzle.

8. A sludge collection system as recited in claim 1, wherein said sludge removal means comprises:

a suction tube having one end attached to the dished portion of one of said containers and extending to the exterior of the steam generator.

9. A sludge collection system as recited in claim 1, further comprising:

a lower deck plate within said open chamber, with said sludge collecting containers being mounted in said lower deck plate.

10. A sludge collection system as recited in claim 1, wherein the steam generator includes a plurality of riser tubes extending through said upwardly open chamber and at least one of said sludge collecting containers is mounted on at least one of said riser tubes.

11. A sludge collection system as recited in claim 1, wherein at least one of said covers is hinged.

12. A sludge collecting system as recited in claim 1, wherein said containers and said covers are sized to fit through existing manways in the steam generator.

13. A sludge collection system for a vertically oriented nuclear steam generator wherein vapors produced in the steam generator pass through means for separating entrained liquid from the vapor prior to the vapor being discharged from the steam generator, said sludge collection system comprising:

an upwardly open chamber for collecting the separated liquid and feedwater entering the steam generator;

a plurality of upwardly open sludge collecting containers positioned within said chamber, wherein each of said containers includes a top rim encompassing an opening leading to the interior of each container; and a plurality of generally flat, perforated covers, each of said covers being positioned over one of said openings such that a gap is formed between the cover and the adjacent top rim;

wherein the steam generator includes a lower deck plate within said upwardly open chamber and a plurality of riser tubes extending through said upwardly open chamber wherein at least one of said sludge collecting containers comprises a pair of semicylindrical sections positioned around one of said riser tubes and adjacent to said lower deck plate, and at least one of said cover plates comprises a pair of semicircular perforated sections positioned around said one of the riser tubes adjacent to said semicylindrical sections, thereby forming an annular gap between said semicircular perforated sections and said semicylindrical sections.

14. A sludge collection system for a vertically oriented nuclear steam generator wherein vapors produced in the steam generator pass through means for separating entrained liquid from the vapor prior to the vapor being discharged from the steam generator, said sludge collection system comprising:

an upwardly open chamber for collecting the separated liquid and feedwater entering the steam generator;

a plurality of upwardly open sludge collecting containers positioned within said chamber, wherein each of said containers includes a top rim encompassing an opening leading to the interior of each container;

a plurality of generally flat, perforated covers, each of said covers being positioned over one of said openings such that a gap is formed between the cover and the adjacent top rim; and a baffle plate mounted within at least one of said sludge collecting containers and positioned below one of said covers.

15. A sludge collection system as recited in claim 14, wherein said baffle plate is shaped to form an annular gap between the interior surface of one of said sludge collecting containers and the baffle plate.

* * * * *